US007204448B2

(12) United States Patent
Heikaus

(10) Patent No.: US 7,204,448 B2
(45) Date of Patent: Apr. 17, 2007

(54) DEVICE FOR PRODUCING FILM ROLLS

(75) Inventor: Gerd Heikaus, Nümbrecht (DE)

(73) Assignee: Illinois Tool Works Inc., Glenview, IL (US)

( * ) Notice: Subject to any disclaimer, the term of this patent is extended or adjusted under 35 U.S.C. 154(b) by 64 days.

(21) Appl. No.: 10/498,312

(22) PCT Filed: Nov. 28, 2002

(86) PCT No.: PCT/EP02/13408

§ 371 (c)(1),
(2), (4) Date: Nov. 17, 2004

(87) PCT Pub. No.: WO03/051751

PCT Pub. Date: Jun. 26, 2003

(65) Prior Publication Data

US 2005/0077416 A1 Apr. 14, 2005

(30) Foreign Application Priority Data

Dec. 14, 2001 (DE) ..... 201 20 240 U

(51) Int. Cl.
*B65H 19/22* (2006.01)

(52) U.S. Cl. ..... 242/533.4; 242/571

(58) Field of Classification Search ..... 242/533, 242/533.4, 533.5, 533.7, 571
See application file for complete search history.

(56) References Cited

U.S. PATENT DOCUMENTS

| | | | | |
|---|---|---|---|---|
| 3,228,621 | A * | 1/1966 | Danahey | 242/533.5 |
| 3,430,881 | A * | 3/1969 | Ebneter | 242/533.5 |
| 3,985,313 | A * | 10/1976 | Klein et al. | 242/533.5 |
| 4,220,291 | A | 9/1980 | Papa | |
| 4,516,742 | A * | 5/1985 | Townsend | 242/533.5 |
| 4,667,890 | A | 5/1987 | Gietman | |
| 4,993,654 | A * | 2/1991 | Suzuki et al. | 242/533.7 |
| 5,743,482 | A * | 4/1998 | Suzuki et al. | 242/533.4 |
| 6,047,916 | A | 4/2000 | Oennerloev | |
| 6,270,034 | B1 * | 8/2001 | Kury et al. | 242/533.4 |
| 2003/0122025 | A1 * | 7/2003 | Suzuki et al. | 242/533.4 |

FOREIGN PATENT DOCUMENTS

| | | |
|---|---|---|
| DE | 199 57 990 A | 6/2001 |
| WO | 99 06312 A | 2/1999 |

* cited by examiner

*Primary Examiner*—William A. Rivera
(74) *Attorney, Agent, or Firm*—Lowe Hauptman & Berner, LLP

(57) ABSTRACT

A device for producing film rolls, which is in particular suitable for producing coreless film rolls, comprises a roll holder for receiving a film roll comprising a film sheet to be wound off. The film sheet is wound up to a winding mandrel for producing the preferably coreless film roll. For producing in particular a coreless film roll the winding mandrel comprises a plurality of radially displaceable holding segments extending in longitudinal direction of the winding mandrel. After transfer of the winding mandrel, together with the wound-up film roll, to a transport means, the winding mandrel is transported to a delivery station. The delivery station serving for automatically delivering the wound-up film roll from the winding mandrel comprises a displacement means with the aid of which the holding elements of the winding mandrel are displaced into a delivery position. In this delivery position the outer diameter of the winding mandrel is smaller such that the film roll is delivered from the winding mandrel and falls onto a transport belt.

15 Claims, 4 Drawing Sheets

DEVICE FOR PRODUCING FILM ROLLS

CROSS-REFERENCES TO RELATED APPLICATIONS

This application corresponds to International Application No. PCT/EP02/13408, filed Nov. 28, 2002, which claims benefit of German Application Serial No. 201 20 240.9, filed Dec. 14, 2001, the entire disclosures of which are hereby incorporated by reference.

FIELD OF THE INVENTION

The invention relates to a device for producing film rolls. In particular, the device can be used for producing coreless film rolls, i.e. film rolls which do not comprise any cardboard core or the like. The device is in particular suitable for producing prestretched or preextended foil sheets.

BACKGROUND OF THE INVENTION

A device for producing coreless film rolls is known from WO 99/06312. The device described herein comprises a roll holder which receives a film roll comprising a film sheet to be wound off. This film sheet is an unstretched film sheet. The film sheet is wound off this film roll, stretched with the aid of a plurality of rolls and wound onto a winding mandrel. For the purpose of stretching the film at least one of the deflection rollers is embossed. Further, the rotational velocity of the individual deflection rollers can be varied such that stretching is effected. With the aid of a control device the film sheet is wound up to the winding mandrel in such a manner that the first layers remain unstretched or are wound up at a low tension and only the following layers of the film sheet are prestretched. This allows a coreless film roll to be produced which can be removed from the winding mandrel.

For removing the coreless film roll from the winding mandrel, winding mandrels are known which comprise a plurality of longitudinal segments and/or holding elements which are displaceable in radial direction. Displacement is effected by a pneumatic unit. With the aid of the pneumatic unit it is thus possible to change the circumference of the winding mandrel, i.e. the joint circumference of the segments arranged on a cylinder shell.

The production of coreless film rolls using the device known from WO 90/06312 has the drawback that the winding mandrel, together with the film sheet wound up to the winding mandrel, must be manually taken out of the machine since the prestretched film must calm down before the winding mandrel can be removed. Thus the film must be allowed to settle over a certain period of time prior to removal of the winding mandrel. The manual action required for this purpose increases the production costs in particular for prestretched film rolls.

SUMMARY OF THE INVENTION

It is an object of the invention to further automate the production process for film rolls, in particular prestretched film rolls without cores.

According to the invention, this object is achieved with the features of claim 1.

According to the invention, the device for producing film rolls comprises a delivery station for automatically delivering the wound-up film roll from the winding mandrel. For this purpose, the delivery station comprises a displacement means for displacing the holding elements of the winding mandrel. The holding elements of the winding mandrel, which are preferably radially displaceable relative to the longitudinal direction of the winding mandrel, serve for varying the outer diameter of the winding mandrel. With the aid of the displacement means according to the invention the holding elements are displaced into a delivery position. In the delivery position the holding elements of the winding mandrel are arranged at a smaller distance to each other. The circumference of the winding mandrel is thus reduced in the delivery position. Since, according to the invention, the winding mandrel is preferably vertically arranged in the delivery station, the wound-up film roll can slip off the winding mandrel also by gravity after actuation of the displacement means.

Due to the automatic taking-off and/or removal of the wound-up film sheet from the winding mandrel, a work step which has so far been manually performed by the operating personnel is omitted. The inventive increase in the degree of automation of the device for producing film rolls results in a considerable reduction of costs.

For promoting the delivery of the film roll from the winding mandrel, preferably a pull-off means for pulling the film roll off the winding mandrel is provided. Preferably, the pull-off means is a ram displaceable in longitudinal direction of the winding mandrel. The ram is adapted to be actuated hydraulically and/or pneumatically. For example, a tubular ram surrounding the winding mandrel may be provided as a ram such that, when the film roll is pulled off the winding mandrel, the inner layer of the film roll is prevented from getting jammed and possibly damaged as a result. It is further possible to provide a ram arranged laterally beside the winding mandrel.

The holding elements of the winding mandrel can be moved by springs or a spreading device from a delivery position into a receiving position and vice versa. For this purpose, the holding elements are arranged at a smaller distance to each other in the delivery position such that the winding mandrel has a diameter which is smaller than the inner diameter of the film roll. In contrast to that, the holding elements of the winding mandrel are arranged at a larger distance to each other in the receiving position in which the film strip is wound up to the winding mandrel, preferably for the purpose of producing a coreless film roll, such that the winding mandrel has a larger diameter substantially corresponding to the inner diameter of the film roll. For displacing the holding elements e.g. a spreading device as described in the subsequently published German Utility Model DE 201 15 648 may be provided. Preferably, the holding elements are adapted to be hydraulically and/or pneumatically actuated since hydraulic and/or pneumatic actuation of the holding elements involves a lower maintenance effort and is easier to automate.

Preferably, the displacement means comprises a relief device. The relief device provides for a relaxation of the holding elements such that they automatically assume the delivery position. For example, springs biasing the holding elements into the receiving position can be released. Preferably, biasing of the holding elements is effected pneumatically and/or hydraulically such that the relief device is preferably configured such that it causes a pressure reduction. For this purpose, the winding mandrel preferably comprises a valve which is adapted to be automatically opened by the relief device. Opening of the valve causes the pressure to be reduced and thus the holding elements to relax. Preferably, the holding elements are connected with a return-motion means, such as a spring. The return-motion means serves for preventing the holding elements from getting jammed in the receiving position and for ensuring that they always return into the delivery position as soon as the pressure is reduced.

For further increasing the degree of automation of the device according to the invention, said device preferably comprises a transport means. With the aid of the transport means the winding mandrels, after the preferably prestretched film sheet has been wound up to said winding mandrels, are transported from a wind-up station to the delivery station. For this purpose, the transport means preferably comprises a plurality of winding mandrel holders. The winding mandrels carrying the wound-up film roll are removed from the wind-up station and transferred to the transport means and/or the winding mandrel holders of the transport means. For this purpose, separate handling means may be provided at the transfer station, which handling means are intended for automatic transfer of the film roll-carrying winding mandrels. Preferably, the winding mandrels are arranged between two holders in the wind-up station. The holders may further be used for driving the winding mandrel for the purpose of winding up the film strip to the winding mandrel. Preferably, the holders are connected with a displaceable or pivotable holding arm for removing the winding mandrel, together with the wound-up film roll, from the wind-up station at the transfer station and for transferring it to the transport means.

The winding mandrel holders of the transport means are preferably configured such that the winding mandrels are vertically arranged in the winding mandrel holders. In particular, the winding mandrels are hung up in the winding mandrel holders. For this purpose, the winding mandrels preferably comprise a suitable head-like enlarged portion which is adapted to be placed on substantially U-shaped horizontally arranged winding mandrel holders. The winding mandrels can be inserted into and removed from such U-shaped winding mandrel holders in horizontal direction.

After relaxation of the holding elements of the winding mandrels in the displacement means, i.e. after the film roll has been removed from the winding mandrel possibly with the aid of the pull-off means, the winding mandrels are expanded again. For this purpose, the holding elements of the winding mandrels are placed into their receiving position in which they serve for receiving the film strip in the wind-up station. In this connection, a roll core, such as a cardboard core, can be received in the receiving position, to which cardboard core the film is then wound up. This allows a film sheet to be wound up to such winding mandrels as described above so that coreless film sheets can be produced.

In the case of the preferred use of pneumatically or hydraulically displaceable holding elements of the winding mandrels, biasing of the holding elements in the expanding station is effected by a pressure increase in the winding mandrel, the pressure increase causing the holding elements to be displaced in radial direction. For this purpose, a preferably displaceable feed head connected with a pneumatic or hydraulic device is provided at the expanding station. Displacement of this head causes preferably the valve, which is also opened for the purpose of pressure reduction in the delivery station, to be opened and preferably compressed air to be fed to the winding mandrel.

It is further possible to configure the delivery station and the expanding station as one single station. This offers the advantage that the relief device, which effects the pressure reduction, may be configured such that immediately after pressure reduction and pulling the film roll off the winding mandrel the pressure can be increased again and the holding elements can be returned into the receiving position.

For further increasing the degree of automation, the transport means is preferably configured as an endless transport means. The transport means thus accepts the winding mandrels, together with the film roll wound up to the winding mandrel, at the transfer station and automatically transports them to the delivery station. After delivery of the film roll, the winding mandrels may then be transported to the expanding station. From said expanding station they are automatically transported to the transfer station where a winding mandrel with holding elements in their receiving position is transferred to the wind-up station. It is in particular advantageous to configure the transport means in such a manner that the winding mandrels, together with the wound-up film roll, are transported between the transfer station and the delivery station over a given minimum period of time. This ensures that in the case of a prestretched film the film has sufficient time to settle so that the film roll can be easily delivered from and/or pulled off the winding mandrel. Provision of such a calming-down distance reduces the occurrence of trouble. For example, a chain with winding mandrel holders arranged in particular at regular intervals can be provided as transport means. Preferably, the transport means is configured as a wheel or a disk, wherein the winding mandrel holders are radially arranged and moved on a circular line.

BRIEF DESCRIPTION OF THE DRAWING

Hereunder the invention is explained in detail in connection with a preferred embodiment with reference to the accompanying drawings in which.

DETAILED DESCRIPTION OF THE INVENTION

Figure 1:
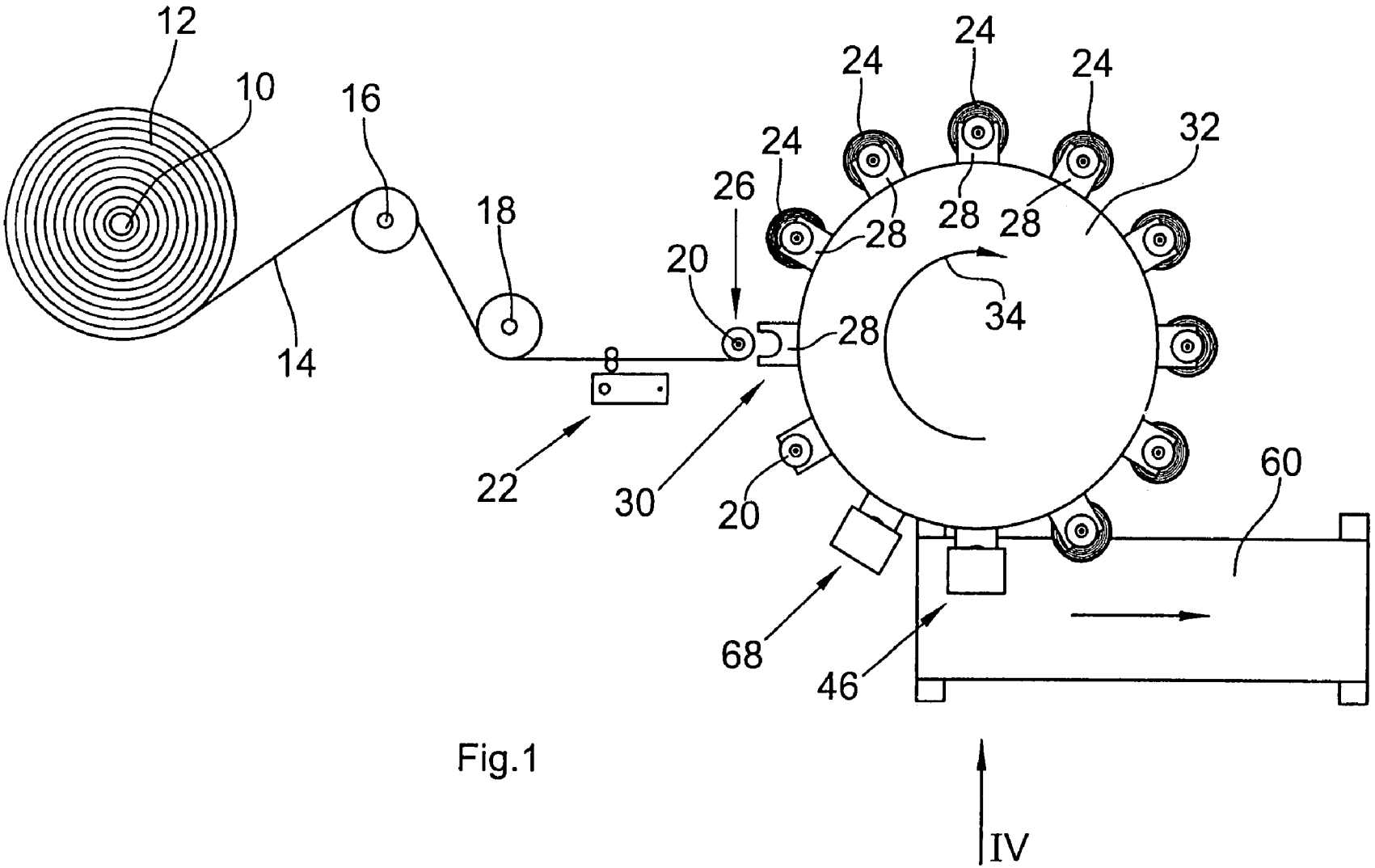
FIG. 1 shows a schematic plan view of the device according to the invention.
Figure 2:
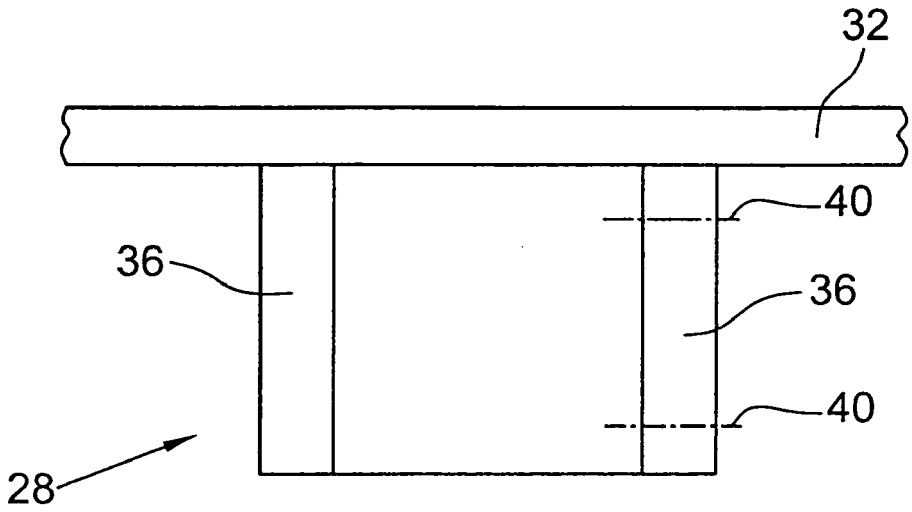
FIG. 2 shows a schematic front view of a winding mandrel holder of the transport means.

The inventive device for producing film rolls comprises, according to the basic structure shown in FIG. 1, a roll holder 10. The roll holder 10 carries a film roll 12 with a generally unstretched film. A film strip 14 is wound off the film roll 12 and guided over a plurality of deflection rolls 16,18. Normally, such devices comprise a plurality of rollers 16,18, which are partly connected with a drive means, wherein the rotational velocity of the individual rollers 16,18 may vary. Thus the film sheet 14 can be stretched. In particular, one or more rollers of the rollers 16,18 may be embossed for promoting the stretching of the film sheet 14.

The film sheet 14 is wound up to a winding mandrel 20 after it has passed over the deflection rollers 16,18. After winding-up of a predetermined length of the film sheet 14 to the winding mandrel 20, the film sheet 14 is cut with the aid of a cutting means 22 which comprises e.g. a knife.

In the illustrated embodiment the winding mandrel 20, together with the wound-up film, i.e. together with the film roll 24 produced, is removed with the aid of an automatic handling means which is not shown, and a new winding mandrel 20 is inserted into the device. For this purpose the handling means comprises e.g. an arm to whose front end a gripper is fastened. With the aid of the gripper the winding mandrel 20, together with the film roll 24 wound up to the mandrel, is removed from the device.

After removal of the winding mandrel 20 carrying the film roll 24 from the device, a new winding mandrel 20 is inserted with the aid of the handling means into the device.

Figure 4:
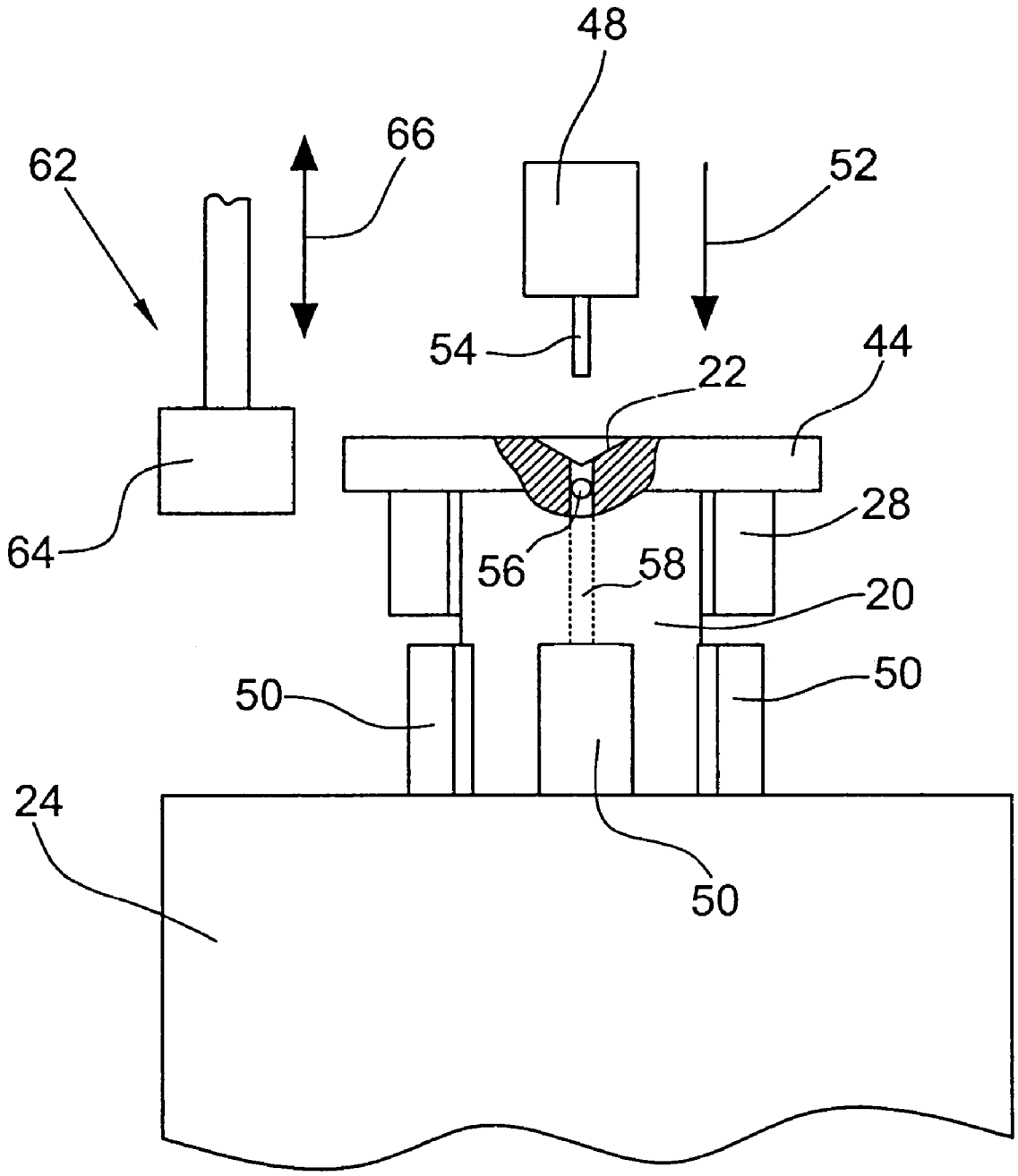
FIGS. 4 and 5 show schematic front views of the delivery station.

The handling means may be configured such that it carries the winding mandrel 20 even when the film sheet 14 is being wound up to the winding mandrel and possibly drives the mandrel. For this purpose, the winding mandrel 20 comprises, at the two opposite ends, conical recesses 22 (FIG. 4) which are engaged by corresponding tips. The two opposite tips may be fastened to a common arm and may be pivotable with the aid of said arm. By pivoting the arm, the winding mandrel 20 is pivoted out of the wind-up station 26 towards a winding mandrel holder 28 and into the transfer station 30.

Subsequently, the transport means 32, configured as a disk or wheel in the illustrated embodiment, is further rotated in the direction indicated by arrow 34 by one station. In this connection, the winding mandrel holder 28 is rotated clockwise into the next position. After rotation of the transport means the winding mandrel holder 28 with the empty winding mandrel 20 is in the transfer station 30. Here, the winding mandrel 20 is gripped by moving the tips into the conical recesses 22 and pivoted such that it is moved into the wind-up station 26.

The next piece of film sheet 14 is now wound up to the winding mandrel 20 newly placed into the wind-up station 26, said piece of film sheet being wound off the film roll 12 to which a considerably longer film sheet is wound up so that a plurality of film rolls 24 can be produced.

Figure 3:
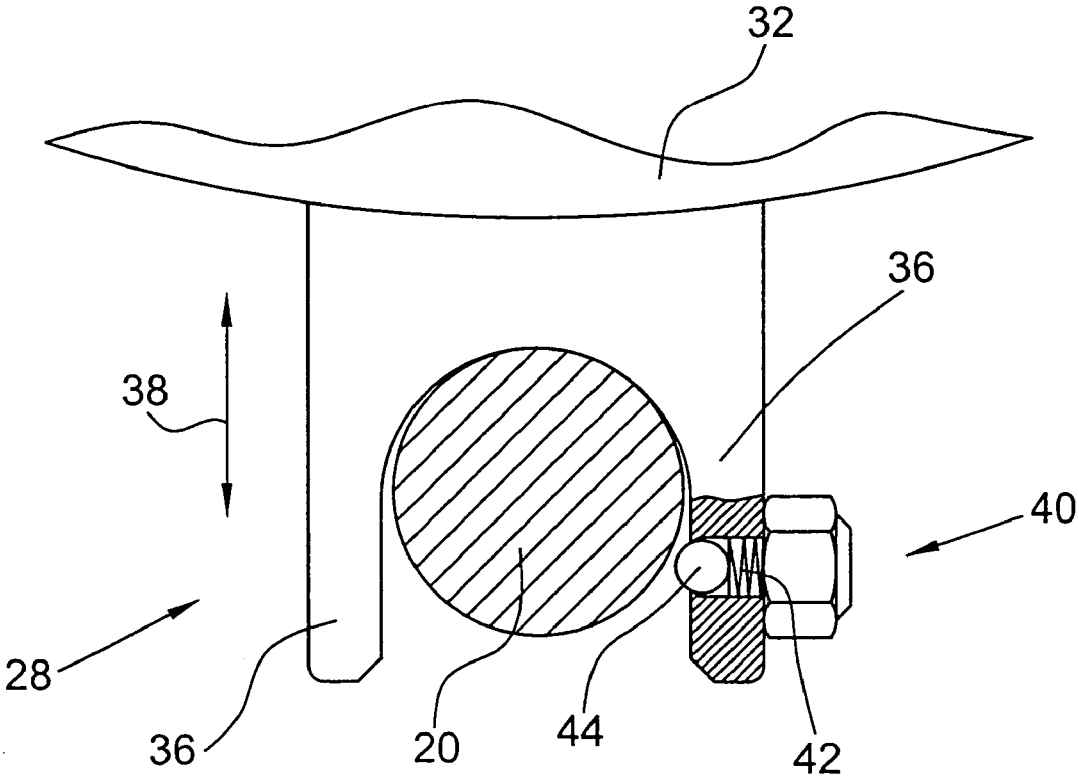
FIG. 3 shows a schematic partially sectional plan view of the winding mandrel holder.

The cross-section of the winding mandrel holder 28 is U-shaped and comprises two opposite arms 36 extending substantially in parallel. The winding mandrel holder is open in radial direction relative to the disk-shaped transport means 32 such that winding mandrels 20 can be removed from the winding mandrel holder 20 and/or inserted into the winding mandrel holder 20 in the direction indicated by arrow 38 (FIG. 3). To prevent the winding mandrel 20 from slipping out of the winding mandrel holder 28, preferably two holding or securing means 40 are provided in at least one of the two arms 36. In the illustrated embodiment, the securing means is a ball 44 biased by a spring 42. When the winding mandrel 20 is removed from or inserted into the winding mandrel holder 28 in the direction indicated by arrow 38, the ball 44 is pressed against the spring force into the arm 36. Thus the winding mandrel 20 is prevented from slipping out of the winding mandrel holder 28.

For each winding mandrel 20 a single winding mandrel holder 28 is provided in which the winding mandrel 20 is vertically hung up. For this purpose, the winding mandrel 20 comprises a plate-shaped head 44 (FIG. 4) which rests on the upper side of the arms 36.

In the illustrated embodiment, the transport means 32 (FIG. 1) comprises 12 winding mandrel holders 28. After nine transport steps a film sheet 14 wound up to the winding mandrel 20 in the wind-up station 26 arrives, after being transferred to the transport means 32 in the transfer station 30, at a delivery station 46. During the transport of the film roll 24 from the delivery station 46 the prestretched film calms down or settles. This calming-down distance or calming-down phase is required to allow the film roll, which, in the illustrated embodiment, is produced as a coreless film roll 24, to be pulled off the winding mandrel 20.

For pulling the film roll 24 off the winding mandrel 20, the delivery station 46 (FIGS. 4 and 5) comprises a displacement means 48. The displacement means 48 serves for displacing holding segments 50 extending in longitudinal direction of the winding mandrel 20. In the illustrated embodiment, the holding segments 50 are pneumatically displaceable in radial direction of the winding mandrel 20. By displacing the holding elements 50 in radial direction the diameter of the winding mandrel 20 can be varied. For pulling the film roll 24 off the winding mandrel 20 and/or the holding elements 50 of the winding mandrel 20 the displacement means 48 is moved in the direction indicated by arrow 52. Thereby a tip 54 presses onto a valve 56 and opens the valve. Thus the air in the winding mandrel can escape via a channel 58. As a result, the holding elements 50 are radially displaced inwardly towards the winding mandrel 20 and into a delivery position, wherein the outer diameter of the winding mandrel 20 is reduced. For this purpose, for example, a spring element or the like can be provided in the winding mandrel 20, the spring element pulling the holding elements 50 inwardly. When the air has escaped, the outer diameter of the winding mandrel 20 is smaller than the inner diameter of the film roll 24. Since the winding mandrel 20 hangs vertically in the winding mandrel holder 28, the film roll 24 can now slip by gravity off the winding mandrel 20 and/or the holding elements 50 of the winding mandrel 20 and fall onto a transport belt 60 (FIG. 1). The transport belt 60 then transports the individual film rolls 24 e.g. to a processing means, such as a packing means.

Since the inner layers of the film roll 24 may adhere to the holding elements 50 of the winding mandrel 20, the gravity sometimes does not suffice so that the film roll 24 does not automatically slip off the winding mandrel when the pressure in the winding mandrel has been reduced, i.e. the diameter of the winding mandrel has been decreased. For promoting pulling of the film roll 24 off the winding mandrel 20, a pull-off means 62 is provided. In the illustrated embodiment, the pull-off means 62 is a ram 64 which is displaceable in the direction indicated by arrow 66. The ram 64 is arranged beside the winding mandrel 20 and presses onto a side surface of the film roll 24 such that the film roll is pushed off the winding mandrel 20 in longitudinal direction of the latter.

Figure 5:
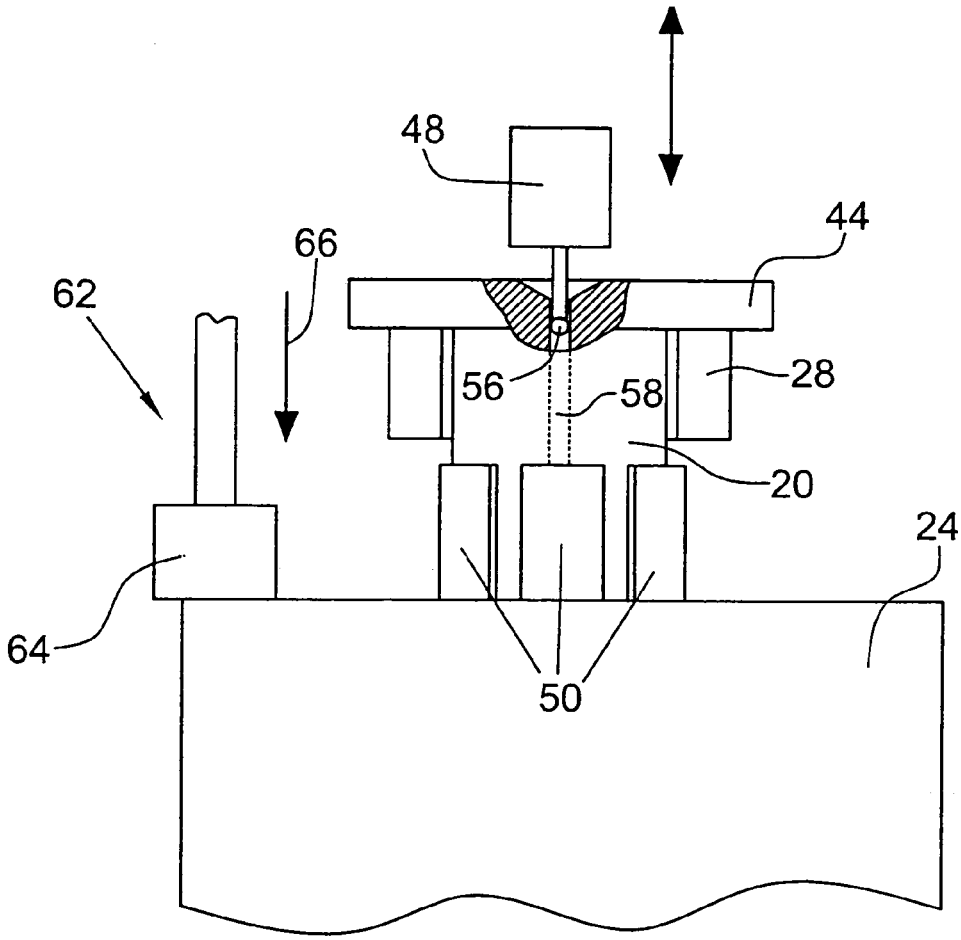
Figure 6:
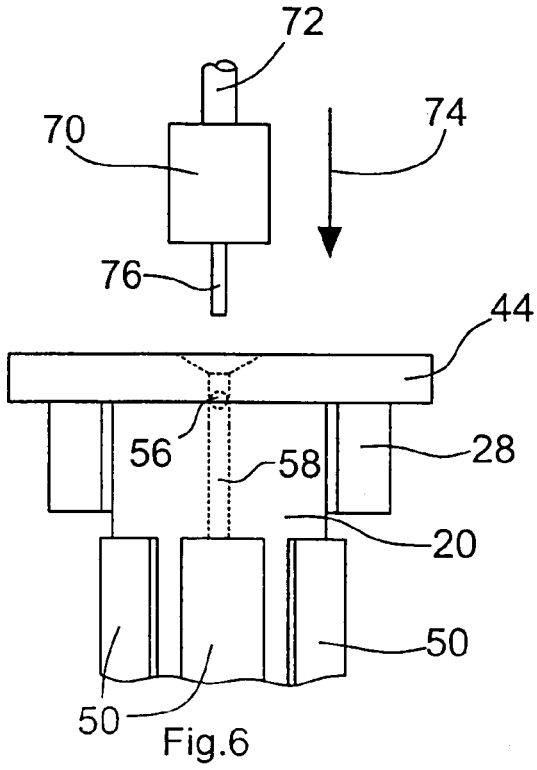
FIG. 6 shows a schematic front view of the expanding station.

When the film roll 24 is pulled off the winding mandrel 20 in the delivery station 46 (FIG. 1), the next piece of film 14 is wound up in the wind-up station 26 to the winding mandrel 20 located in the wind-up station. After pulling-off the film roll 24 in the delivery station 46, winding-up the next piece of film sheet 14 to the winding mandrel 20 in the wind-up station 26, and transferring the winding mandrel now carrying the film roll 24 to the transport means 32 in the transfer station 30, the transport means 32 is rotated by a further transport step in the direction indicated by arrow 34. Thereby the winding mandrel 20 moves from the delivery station 46 to an expanding station 68 (FIGS. 1 and 5). In the expanding station the holding elements 50 of the winding mandrel 20 are expanded again, i.e. the outer diameter of the winding mandrel 20 is increased again such that the holding elements 50 resume the receiving position, i.e. another film sheet 14 can be wound up to the winding mandrel 20. For this purpose, air is pumped via a pneumatic head 70 into the winding mandrel 20. The pneumatic head 70 is connected via a hose 72 with a pressure-generating means. For displacing the holding elements 50 the pneumatic head 70 is displaced in the direction indicated by arrow 74 such that a stud 76 opens the valve 56 and air can be pumped through the channel 58 into the winding mandrel 20. Thereby the holding elements 50 are radially displaced and/or biased outwardly. After another two transport steps of the transport means 32 in the direction indicated by arrow 34 (FIG. 1), the newly biased winding mandrel 20 is, in the transfer station 30, transferred again to the wind-up station 26.

The invention claimed is:

1. A device for producing coreless film rolls, comprising:

a winding mandrel onto which a film sheet is adapted to be wound for producing a coreless film roll, a transport arrangement comprising a rotatable member configured to be rotatable about an essentially vertical axis and configure to support the winding mandrel in a manner wherein an axis of the mandrel is essentially parallel to the essentially vertical axis about which the rotatable member is rotatable;

wherein the winding mandrel comprises a plurality of displaceable holding elements arranged in a longitudinal direction of the winding mandrel, the holding elements being operative for changing outer dimensions of the winding mandrel and having surfaces which are configured to directly engage the film sheet when it is wound onto the winding mandrel and to be retracted away and out of engagement with the coreless film roll when winding of the coreless film roll is to be separated from winding mandrel, and a delivery station for separating the coreless wound-up film roll from the winding mandrel, the delivery station comprising a displacement device for displacing the coreless wound up film roll with respect to the mandrel when the mandrel assumes a delivery position so that the coreless wound up film roll is collected on a transport belt which has an essentially horizontal surface.

2. A device according to claim 1, wherein the displacement device comprises a release device for allowing the holding elements to move inwardly to the release positions and away from the coreless film roll and receiving positions to which the holding elements are biased to engage with the coreless film roll during the winding of the coreless film roll.

3. A device according to claim 2, wherein the holding elements are biased into the receiving positions and wherein a release device relieves the bias and induces the holding elements to move out of contact with the coreless film roll and into the release positions by reducing the bias in the delivery position.

4. A device according to claim 3, wherein the bias is produce using one of hydraulic and pneumatic pressure and wherein the winding mandrel comprises a valve adapted to be opened for pressure reduction and the movement of the holding elements from the receiving positions to the release positions.

5. A device according to claim 1, wherein the displacement device comprises a pull-off device for moving the film roll off the winding mandrel.

6. Device according to claim 5, wherein the pull-off device comprises a ram adapted to be displaced in a longitudinal direction of the winding mandrel.

7. A device according to claim 1, wherein the transport arrangement transports the winding mandrel from a wind-up station where the film sheet is wound onto the winding mandrel, to the delivery station.

8. A device according to claim 7, wherein the transport arrangement comprises a plurality of winding mandrel holders each supported on the rotatable member for moving the winding mandrels from the wind-up station to the delivery station.

9. A device according to claim 8, wherein the winding mandrel holders are configured such that the winding mandrel is adapted to be removably hung thereon.

10. A device according to claim 8, wherein a transfer station transfers the winding mandrel from the wind-up station to the rotatable member.

11. A device according to claim 7, wherein the transport arrangement is configured as an endless transport arrangement.

12. A device according to claim 1, wherein an expanding station is located downstream of the delivery station and is operative for conditioning the winding mandrel so that the holding elements are biased into their receiving positions.

13. A device for producing coreless film rolls, comprising:

a plurality of winding mandrels onto each of which a selected amount of film sheet is adapted to be wound, said winding mandrels each comprising a plurality of operatively connected, displaceable holding element means for selectively varying outer dimensions of the winding mandrel and for providing surfaces which directly engage the film sheet when it is wound onto the winding mandrel, the holding element means being configured for retraction away and out of engagement with the coreless film roll for post winding separation of the coreless film rolls from the respective mandrel, and transport means which comprises a rotating element that is rotatable about an essentially vertical axis and that carries the coreless film rolls respectively wound at a winding station, to a delivery station whereat each coreless film roll is separated vertically downward from the mandrel on which it is supported and whereafter each mandrel is subsequently expanded at an expansion station located downstream of the delivery station so as to assume a condition ready to have further film wound thereon at the winding station.

14. A device according to claim 13, wherein the holding element means are constantly connected with the winding mandrels and form an operative part thereof.

15. A device according to claim 13, wherein the delivery station is configured to displace the coreless film rolls vertically downward from the mandrels on which they are carried, onto a transport belt.

* * * * *